US010814950B2

(12) United States Patent
Avsic et al.

(10) Patent No.: US 10,814,950 B2
(45) Date of Patent: Oct. 27, 2020

(54) UNDERWATER CRAFT LESS LIKELY TO BE DETECTED ACROSS GREAT DISTANCES

(71) Applicants: THYSSENKRUPP MARINE SYSTEMS GMBH, Kiel (DE); thyssenkrupp AG, Essen (DE)

(72) Inventors: Tom Avsic, Altenholz (DE); Randolf Teppner, Quickborn (DE)

(73) Assignees: THYSSENKRUPP MARINE SYSTEMS GMBH, Kiel (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 16/463,644

(22) PCT Filed: Nov. 20, 2017

(86) PCT No.: PCT/EP2017/079823
§ 371 (c)(1),
(2) Date: May 23, 2019

(87) PCT Pub. No.: WO2018/095873
PCT Pub. Date: May 31, 2018

(65) Prior Publication Data

US 2019/0315445 A1 Oct. 17, 2019

(30) Foreign Application Priority Data

Nov. 24, 2016 (DE) ..... 10 2016 014 108

(51) Int. Cl.
*B63G 8/34* (2006.01)
*B63B 3/18* (2006.01)
*B63B 3/13* (2006.01)

(52) U.S. Cl.
CPC . *B63G 8/34* (2013.01); *B63B 3/13* (2013.01)

(58) Field of Classification Search
CPC .... B63B 3/00; B63B 3/13; B63G 8/00; B63G 8/001; B63G 8/04; B63G 8/16; B63G 8/34; B63C 7/00; B63C 7/16
(Continued)

(56) References Cited

U.S. PATENT DOCUMENTS 1,432,142 A * 10/1922 Von Sanden ..... B63B 3/13 114/342
1,500,997 A 7/1924 Knox
(Continued)

FOREIGN PATENT DOCUMENTS

DE 1 196 531 B 7/1965
DE 196 23 127 C 6/1997
(Continued)

OTHER PUBLICATIONS

English Translation of International Search Report issued in PCT/EP2017/079823, dated Apr. 16, 2018.

*Primary Examiner* — Lars A Olson
(74) *Attorney, Agent, or Firm* — thyssenkrupp North America, LLC

(57) ABSTRACT

An underwater craft is considerably less likely to be detected by sonar if the underwater craft includes an outer hull as disclosed herein, which outer hull may extend in a longitudinal direction through a stern section, through a midship section, and through a bow section. The outer hull in the midship section may have a polygonal cross section. The outer hull of the midship section may also have curvature along the longitudinal direction throughout the midship section. A ratio of a radius of curvature to a total length of the underwater craft in the longitudinal direction may be between 5 and 1000. Further, a cylindrical pressure vessel may be disposed under the outer hull.

20 Claims, 2 Drawing Sheets

(58) Field of Classification Search
USPC ..... 114/312, 342
See application file for complete search history.

(56) References Cited

U.S. PATENT DOCUMENTS

| | | | | |
|---|---|---|---|---|
| 2,942,681 | A * | 6/1960 | Lindman | B63G 8/04 114/312 |
| 3,648,635 | A * | 3/1972 | Hashemi | B63G 8/001 114/321 |
| 4,577,583 | A | 3/1986 | Green, II | |
| 2005/0145159 | A1 | 7/2005 | Barsoum | |

FOREIGN PATENT DOCUMENTS

| | | | |
|---|---|---|---|
| DE | 197 54 333 | A | 6/1998 |
| EP | 0 850 830 | A | 7/1998 |
| GB | 531 892 | A | 1/1941 |
| JP | H04130287 | A | 5/1992 |
| KR | 10-2012-0089816 | A | 8/2012 |
| KR | 10-2015-0002986 | A | 1/2015 |

* cited by examiner

UNDERWATER CRAFT LESS LIKELY TO BE DETECTED ACROSS GREAT DISTANCES

CROSS REFERENCE TO RELATED APPLICATIONS

This application is a U.S. National Stage Entry of International Patent Application Serial Number PCT/EP2017/079823, filed Nov. 20, 2017, which claims priority to German Patent Application No. DE 10 2016 014 108.5, filed Nov. 24, 2016, the entire contents of both of which are incorporated herein by reference.

FIELD

The present disclosure generally relates to underwater craft, including submarines as well as avoiding detection by sonar.

BACKGROUND

Underwater craft, in particular military submarines, currently conventionally have, in simplified form, a cylindrical basic shape in the midship area with a hemispherical bow and a conical stern. This shape is streamlined and can readily be manufactured as a single hull boat or double hull boat.

For the detection of submarines, use is made nowadays in particular of sonar, wherein the intention is for the detection to take place preferably across great distances, for example 100 km. This leads to the sound waves of the sonar striking against an underwater craft at a very shallow angle parallel to the water surface. In order to avoid detection, it is necessary to avoid reflecting the soundwaves, in particular toward the transmitter where the receiver is generally also located. It follows from this geometrical consideration that the likelihood of detection of an underwater craft across a great distance is dependent in particular on the reflection of sound at an angle of ±20°, in particular at an angle of ±10°.

At short distances, other localization possibilities, in particular heat, sound emission, magnetic behavior and many other possibilities are relevant, and therefore the likelihood of detection here is regularly determined by other parameters.

However, a cylindrical body has the property of reflecting a wave isotropically virtually vertically and therefore of outputting virtually the same energy in all vertical directions in space. This leads to the detection within the critical shallow angular range not being particularly low.

U.S. Pat. No. 1,500,997 discloses a plate-like cladding of a submarine in order to reduce the signature.

GB 531 892 A discloses an electrically driven miniature submarine.

DE 196 23 127 C1 discloses a sound absorber for reducing the target size.

DE 197 54 333 A1 discloses a catamaran submarine.

DE 1 196 531 A discloses an underwater craft having a curved surface.

US 2005/0145159 A1 discloses a ship's hull structure which comprises a curvature.

Thus a need exists for an underwater craft which has a significantly reduced likelihood of detection under the conditions of localization across a distance.

DETAILED DESCRIPTION

Figure 1:
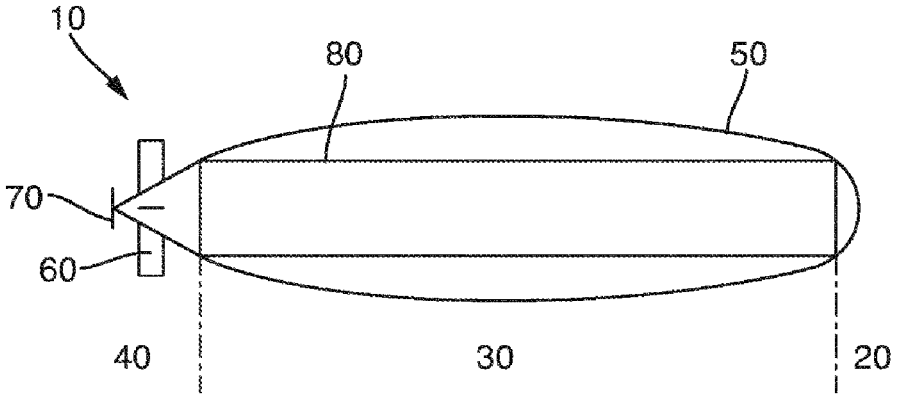
FIG. 1 is a top view of an example underwater craft.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to underwater crafts, such as submarines, which have an outer shape that is optimized to reduce the likelihood of detection by means of active sonar. By way of this optimized outer shape, the distance from which it is likely that an underwater craft can be detected is significantly reduced.

The underwater craft according to the invention that is less likely to be detected has an outer hull. The underwater craft has a bow section, a stern section and a midship section. The outer hull of the midship section has a polygonal cross section transversely with respect to the longitudinal direction of the underwater craft. Furthermore, the outer hull of the midship section has a curvature along the longitudinal direction of the underwater craft over the entire length of the midship section.

The polygonal cross section per se is known for the targeted reflection of a detection wave in a direction differing from the transmitter. This is known in principle in aircraft manufacturing or shipbuilding, for example the Sea Shadow. Large, flat and tilted surfaces are used here as reflectors.

This by itself has the disadvantage that reflections of a higher order also occur at different angles and thus detectability can take place even in the critical shallow angular range. Furthermore, such an arrangement by itself is also not as effective for a submarine as, for example, for an aircraft since a submarine is surrounded by a plurality of boundary surfaces at which a reflection to the transmitter can take place. Such boundary surfaces are, for example, above all the sea bed and the water surface, but also surfaces which may arise from the stratification of the sea water and constitute reflection planes.

In order to minimize this disadvantage, according to the invention the outer hull of the midship section comprises a curvature along the longitudinal direction of the underwater craft. By this means, the two effects—reflection and dispersion—occur. An effect is that the energy of the detection wave in the critical shallow angular range can be significantly minimized. The curvature of the outer hull of the midship section extends over the entire length of the midship section. The curvature here can comprise a variable radius of curvature over the length, but the radius of curvature must not be infinite. This would cause the formation at least at one point of a flat surface which would reflect an incoming beam without dispersion.

The midship section is arranged between the bow section and the stern section. The bow section comprises a length of 5% to 40%, preferably of 5% to 30%, particularly preferably of 5% to 20% of the overall length of the underwater craft, wherein the bow section begins at the bow of the underwater craft. The stern section comprises a length of 5% to 40%, preferably of 5% to 30%, particularly preferably of 5% to 20% of the overall length of the underwater craft, wherein the stern section begins at the stern of the underwater craft. The midship section therefore comprises a length of 20% to 90%, preferably of 40% to 90%, particularly preferably of 60% to 90% of the overall length of the underwater craft.

This enables the power of the wave reflected in the transmitter direction to be reduced by a factor of, for example, 10 000, in relation to a conventional cylindrical underwater craft. By this means, the distance over which detection is likely is reduced by up to an order of magnitude. This significantly increases the freedom of movement of an underwater craft.

Examples of a polygonal cross section may include a triangle or a square, said two polygons being rather less preferred because of the little possibility of adaptation. By contrast, polygons having 5 to 10 corners or sides are preferred, with the length of the sides furthermore preferably differing. Opposite sides of in each case identical length in pairs are particularly preferred.

In a further embodiment of the invention, the polygonal cross section comprises rounded corner regions. This is advantageous in terms of manufacturing and hydrodynamic.

In a further embodiment of the invention, the polygonal cross section comprises a mirror plane perpendicularly to the longitudinal axis. This means that the outer contour of the port side and of the starboard side are identical.

In a further embodiment of the invention, the outer hull of the midship section comprises a curvature along the longitudinal direction of the underwater craft over the entire cross section transversely with respect to the longitudinal direction of the underwater craft.

In a further embodiment of the invention, the outer hull comprises at least one first segment, wherein the first segment forms a first conical section in the longitudinal direction of the underwater craft or is composed of two or more conical sections. A segment is defined as a region which is bounded at the top and bottom by the edges of the polygonal cross section. The extent of the segment is bounded in the longitudinal direction by the extent of the midship section. A conical section is a partial region of the convex surface of a cone. A first segment and a corresponding second segment lying on the opposite side of the ship particularly preferably comprise mirror-inverted conical segments. A cone is a geometrical figure which is defined over height and radius. In the case of a conical segment, the radius of curvature therefore changes continuously transversely with respect to the longitudinal direction of the underwater craft. Of course, it can also be a conical segment of an oblique cone, in which the vertical axis does not lie centrally with respect to the circular base.

In a further embodiment of the invention, the outer hull comprises at least one third segment, wherein the third segment forms a third conical section at least in portions, preferably completely, in the longitudinal direction of the underwater craft, wherein the height and/or the radius of the third conical section are different from the height and/or the radius of the first conical section.

In a further embodiment of the invention, the cone of the conical section comprises a height, wherein the ratio of height to length of the underwater craft is between 0.5 and 1000, preferably between 3.5 and 130, particularly preferably between 8.0 and 35.

In a further embodiment of the invention, the cone of the conical section comprises a diameter, wherein the ratio of the cone diameter to the length of the underwater craft is between 2 and 100, preferably between 6 and 50, particularly preferably between 10 and 20.

In a further embodiment of the invention, the underwater craft comprises a tower in the midship section. The tower particularly preferably comprises outer walls which are inclined by at least 10°, particularly preferably by at least 20°, in relation to the perpendicular.

The tower particularly preferably comprises the same angle as the adjacent side of the polygonal cross section below the tower.

In a further embodiment of the invention, the curvature of the midship section comprises a radius of curvature, wherein the ratio of the radius of curvature to the length of the underwater craft is between 5 and 1000, preferably between 10 and 250, particularly preferably between 25 and 100.

The curvature of the midship section does not have to be constant over the entire length. The curvature of the midship section, in particular adjacent to the bow section and/or the stern section, may increase toward the sections, for example in order to provide a transition.

Preferably, the curvature increases in the transition from the midship area to the bow section and decreases in the transition from the midship area to the region of the stern section.

For example, for an underwater craft having a length of 80 m, a curvature of the midship section is therefore produced, the curvature bringing about a cross-sectional enlargement of an imaginary circle surrounding the midship area in relation to an uncurved, rectilinear cylindrical shape by approximately 0.5 m to 2 m, with the tower or other superstructures or extensions not being taken into consideration conceptually here.

In a further embodiment of the invention, the polygonal cross section comprises a widest point, wherein the widest point of the polygonal cross section is arranged below or above the center, wherein the center is defined as half the height of the polygonal cross section.

The deviation from a symmetrical configuration makes it possible in a targeted manner to deflect a greater portion of the incoming detection wave in the same direction. If the widest point is located below the center, the greater portion is reflected upward and therefore to the water surface. If the widest point is located above the center, the greater portion is reflected downward and therefore to the sea bed. The first variant is preferred for stability of the boat, and the second variant for reducing the target size.

In a further embodiment of the invention, the widest point of the polygonal cross section is arranged at least 10%, preferably at least 20% of half the height of the polygonal cross section below or above the center.

In a further embodiment of the invention, all of the planes of the polygonal cross section comprise an inclination of at least 10°, preferably of at least 20°, in relation to the perpendicular.

In a further embodiment of the invention, all of the planes of the polygonal cross section comprise an inclination of 10° to 40° or 50° to 80° in relation to the perpendicular. The angle of 45° should also be avoided since in this case the incoming wave is reflected, for example, onto the water surface, is reflected back by the latter and is then reflected again directly to the transmitter. Although the intensity is lower because of the multiple reflection, it is nevertheless significantly increased in comparison to other angles.

In a further embodiment of the invention, the outer hull comprises a sound-absorbing property. In addition to the optimized geometry, the outer hull can be composed of a sound-absorbing material, comprise the latter or can be coated therewith. Since the absorption can never be complete, the combination of both effects is positive.

In a further embodiment of the invention, the outer hull is substantially reflecting and/or absorbing for soundwaves in the frequency range of 100 Hz to 100 kHz, in particular in the range of 1 kHz to 25 kHz. Since other, non-optimized structures can be arranged under the outer hull, the transmission through the outer hull has to be kept as low as possible. By definition, the sum of degree of reflection, degree of absorption and degree of transmission is 1. Substantially reflecting and/or absorbing is considered to be when the degree of reflection and/or the degree of transmission is at least 0.75, preferably at least 0.9, particularly preferably at least 0.95.

In a further embodiment of the invention, the underwater craft has a substantially cylindrical pressure vessel under the outer hull.

In a further embodiment of the invention, the outer hull does not completely surround the cylindrical pressure vessel. The pressure vessel therefore forms the outer hull in regions. This may be the case, for example, at more uncritical points, for example on the lower side.

In a further embodiment of the invention, sensors, in particular passive sonar sensors and/or fuel stores are arranged between the outer hull and the pressure vessel.

Fuel stores comprise all forms of stored goods which are required for operating the submarine, for example these are petrol or diesel tanks, hydrogen stores, for example in the form of compressed-gas stores, liquid hydrogen stores or metal hydride stores, oxygen stores, for example in the form of compressed-gas stores or liquid oxygen stores, methanol stores, ethanol stores, batteries, accumulators and compressed-gas stores for gas turbines, but also for autonomous or remote-controlled underwater craft, and weapons, such as, for example, torpedoes or missiles, or decoys.

In a further embodiment of the invention, a propeller is arranged level with the widest point of the outer skin.

In a further embodiment of the invention, the underwater craft is a submarine. The underwater craft is preferably a military underwater craft, particularly preferably a military submarine.

FIG. 1 illustrates a top view of an underwater craft 10 having a bow section 20, a midship section 30 and a stern section 40, wherein the underwater craft comprises a rudder 60, here in the form of a cross rudder, and a propeller 70, in the stern section 40. The underwater craft 10 comprises an outer hull 50 which comprises a curvature of the midship section in the longitudinal direction of the underwater craft 10, as can be seen in comparison to a pressure vessel 80 illustrated in simplified form as a cylinder. In practice, the pressure vessel 80 will also comprise rounded ends, preferably hemispherical ends, at the bow and at the stern, which has been left out here for simplification purposes. The pressure vessel 80 also does not have to take up the full length. In particular, weapon tubes can be arranged in the bow.

Figure 2:
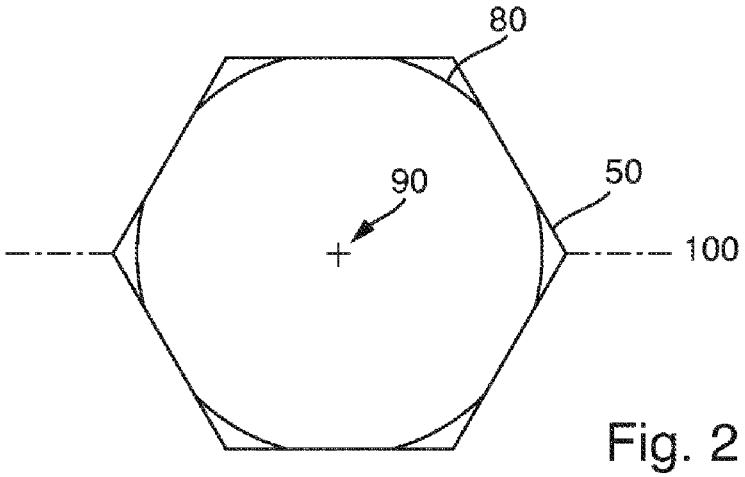
FIG. 2 is a cross-sectional view of an example underwater craft.

FIG. 2 shows a first exemplary cross section. The outer hull 80 has a hexagonal cross section, the widest point 100 lies precisely level with the center 90 which is formed by the center point of the cylindrical pressure vessel 80. This point is correspondingly used here and below as the center in accordance with half the height of the polygonal cross section since they virtually coincide, but the center point can be illustrated more easily visually. All of the surfaces of the outer hull 50 are at an angle of 30° or 90° in relation to the perpendicular.

Figure 3:
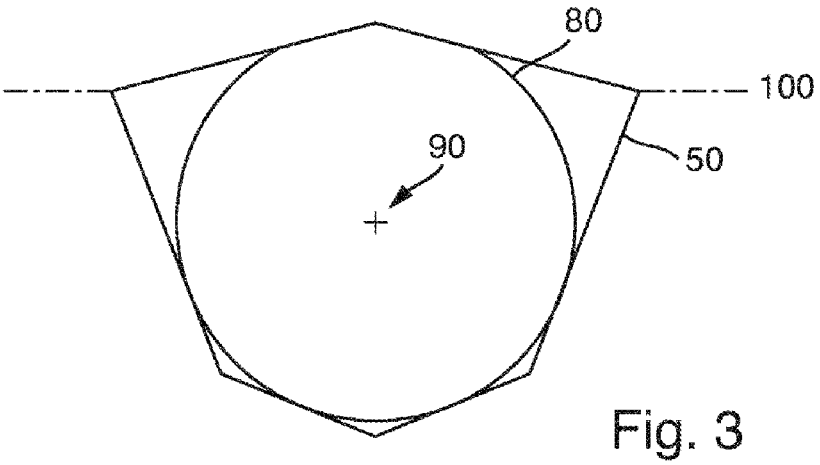
FIG. 3 is a cross-sectional view of another example underwater craft.

FIG. 3 shows a second exemplary cross section. The outer hull 80 comprises an irregular hexagonal cross section, wherein the widest point 100 is arranged significantly above the center 90. By this means, a large portion of the incident waves is reflected to the sea bed, which results in a further minimization of the likelihood of detection.

Figure 4:
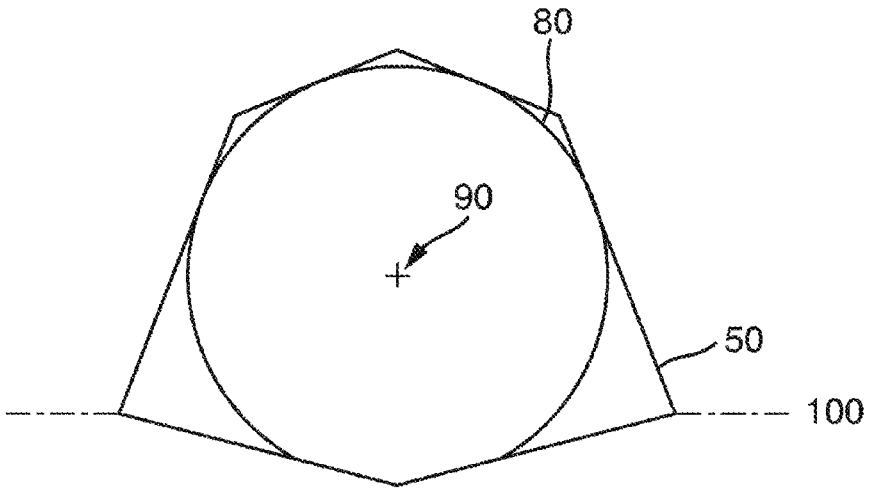
FIG. 4 is a cross-sectional view of still another example underwater craft.
Figure 5:
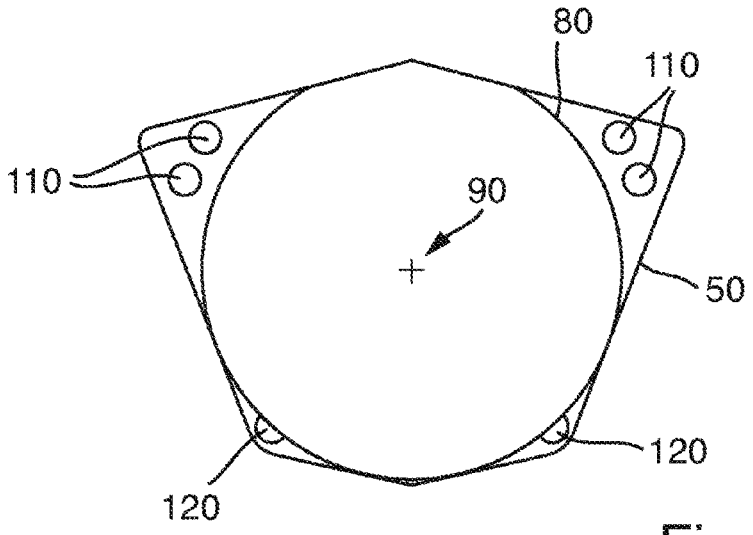
FIG. 5 is a cross-sectional view of a still further example underwater craft.

FIG. 4 shows a third exemplary cross section. The outer hull 80 comprises an irregular hexagonal cross section, wherein the widest point 100 is arranged significantly below the center 90. Although a large portion of the incident waves is thereby reflected to the water surface, the center of gravity of the underwater craft 10 can, however, be arranged lower. This is advantageous for the stability of the underwater craft 10.

In contrast to FIG. 2 to FIG. 4, FIG. 5 shows a cross section having rounded corners which otherwise is basically identical to the second exemplary cross section from FIG. 3. In addition, fuel stores 110 and sonar sensors 120 are arranged between the outer hull 50 and the pressure vessel 80.

All of the cross sections shown in FIG. 2 to FIG. 5 are of mirror-symmetrical design. This is not necessary, but is preferred.

REFERENCE SIGNS

10 Underwater craft
20 Bow section
30 Midship section
40 Stern section
50 Outer hull
60 Rudder
70 Propeller
80 Pressure vessel
90 Center
100 Widest point
110 Fuel store
120 Sonar sensors

What is claimed is:

1. An underwater craft comprising:

an outer hull that extends in a longitudinal direction through a stern section, a midship section, and a bow section, wherein with respect to a plane that is transverse to the longitudinal direction the outer hull in the midship section has a polygonal cross section, wherein the midship section has a length extending in the longitudinal direction, wherein the outer hull has curvature along the longitudinal direction over the length of the midship section, wherein the curvature comprises a radius of curvature, wherein a ratio of the radius of curvature to a total length of the underwater craft in the longitudinal direction is between 5 and 1000; and a substantially cylindrical pressure vessel disposed under the outer hull.

2. The underwater craft of claim 1 wherein the polygonal cross section comprises rounded corner regions.

3. The underwater craft of claim 1 wherein the polygonal cross section is symmetric about a line that is perpendicular to the longitudinal direction.

4. The underwater craft of claim 1 wherein the outer hull is curved along the longitudinal direction over the length of the midship section over a cross section transverse to the longitudinal direction.

5. The underwater craft of claim 4 wherein the outer hull forms a conical section in the longitudinal direction or the outer hull is comprised of two or more conical sections.

6. The underwater craft of claim 1 comprising a tower in the midship section.

7. The underwater craft of claim 1 wherein all planes of the polygonal cross section comprise an inclination of at least 10° relative to a perpendicular.

8. The underwater craft of claim 1 wherein all planes of the polygonal cross section comprise an inclination of 10° to 40° or 50° to 80° relative to a perpendicular.

9. The underwater craft of claim 1 wherein the outer hull has a sound-absorbing property.

10. The underwater craft of claim 1 wherein the outer hull is substantially reflecting and/or absorbing for soundwaves in a frequency range of 100 Hz to 100 kHz.

11. The underwater craft of claim 1 comprising sensors and/or fuel stores disposed between the outer hull and the substantially cylindrical pressure vessel.

12. An underwater craft comprising:

an outer hull that extends in a longitudinal direction through a stern section, a midship section having a length in the longitudinal direction, and a bow section, wherein a cross section of the outer hull in the midship section is polygonal-shaped, wherein the outer hull has curvature along the longitudinal direction throughout the length of the midship section, wherein the curvature of the outer hull along the longitudinal direction throughout the length of the midship section has a radius of curvature, wherein a ratio of the radius of curvature to a total length of the underwater craft in the longitudinal direction is between 10 and 250; and a cylindrical pressure vessel disposed under the outer hull.

13. The underwater craft of claim 12 wherein the polygonal-shaped cross section comprises rounded corner regions.

14. The underwater craft of claim 12 wherein the polygonal-shaped cross section is symmetrical.

15. The underwater craft of claim 12 wherein the cross section of the outer hull is curved along the longitudinal direction over the length of the midship.

16. The underwater craft of claim 15 wherein the outer hull comprises a conical section in the longitudinal direction.

17. The underwater craft of claim 12 comprising sensors and fuel stores disposed between the outer hull and the cylindrical pressure vessel.

18. An underwater craft comprising:

an outer hull that extends in a longitudinal direction through a stern section, a midship section, and a bow section, wherein with respect to a plane that is transverse to the longitudinal direction the outer hull in the midship section has a polygonal cross section, wherein a center of the polygonal cross section is half of a height of the polygonal cross section, wherein a widest point of the polygonal cross section is disposed below or above the center, wherein the widest point of the polygonal cross section is at least 10% of half of the height of the polygonal cross section below or above the center, wherein the midship section has a length extending in the longitudinal direction, wherein the outer hull has curvature along the longitudinal direction over the length of the midship section; and a substantially cylindrical pressure vessel disposed under the outer hull.

19. An underwater craft comprising:

an outer hull that extends in a longitudinal direction through a stern section, a midship section, and a bow section, wherein with respect to a plane that is transverse to the longitudinal direction the outer hull in the midship section has a polygonal cross section, wherein all planes of the polygonal cross section comprise an inclination of at least 10° relative to a perpendicular, wherein the midship section has a length extending in the longitudinal direction, wherein the outer hull has curvature along the longitudinal direction over the length of the midship section; and a substantially cylindrical pressure vessel disposed under the outer hull.

20. An underwater craft comprising:

an outer hull that extends in a longitudinal direction through a stern section, a midship section, and a bow section, wherein with respect to a plane that is transverse to the longitudinal direction the outer hull in the midship section has a polygonal cross section, wherein the midship section has a length extending in the longitudinal direction, wherein the outer hull has curvature along the longitudinal direction over the length of the midship section, wherein the outer hull is substantially reflecting and/or absorbing for soundwaves in a frequency range of 100 Hz to 100 kHz; and a substantially cylindrical pressure vessel disposed under the outer hull.

* * * * *